US006453128B2

(12) United States Patent
Park

(10) Patent No.: US 6,453,128 B2
(45) Date of Patent: Sep. 17, 2002

(54) PAPER SEPARATING APPARATUS OF PRINTER

(75) Inventor: Moon-bae Park, Suwon (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 95 days.

(21) Appl. No.: 09/750,291

(22) Filed: Dec. 29, 2000

(30) Foreign Application Priority Data

Dec. 30, 1999 (KR) ..... 99-65986

(51) Int. Cl.[7] ..... G03G 15/00; G03G 15/16; G03G 15/20

(52) U.S. Cl. ..... 399/22; 271/312; 399/307; 399/397

(58) Field of Search ..... 399/22, 307, 323, 399/398, 399; 118/60; 271/307, 311, 312, 900

(56) References Cited

U.S. PATENT DOCUMENTS 3,844,252 A * 10/1974 Thettu ..... 118/60
4,065,120 A * 12/1977 Imaizumi et al. ..... 271/311
6,243,556 B1 * 6/2001 Shin ..... 271/309

* cited by examiner

*Primary Examiner*—Joan Pendegrass
(74) *Attorney, Agent, or Firm*—Sughrue Mion, PLLC

(57) ABSTRACT

A paper separating apparatus of a printer includes a separating member installed to be adjacent to an exit side of the transfer roller and under a path along which the paper is discharged and fixedly coupled to a pair of bearing guides which rotatably support opposite ends of the transfer roller to be capable of pivoting by a predetermined angle together with the bearing guides, a guide roller installed at an upper surface of the separating member for guiding discharge of the paper, a pivot restricting mechanism for restricting the pivot angles of the separating member and the bearing guides, and an elastic force applying mechanism for applying an elastic force in one direction so that the separating member and the bearing guides can maintain regular positions.

11 Claims, 8 Drawing Sheets

PAPER SEPARATING APPARATUS OF PRINTER

BACKGROUND OF THE INVENTION

1. Field of the Invention

The present invention relates to a paper separating apparatus of a printer for preventing the type of paper jam wherein a sheet of paper supplied to the printer is wound around and stuck to a transfer roller.

2. Description of the Related Art

In general, a printing apparatus, such as a printer or a photocopier, forms an electrostatic latent image on an optical photoreceptor such as a photosensitive drum or a photoreceptor web, develops the electrostatic latent image with developer having a predetermined color, and prints the developed image on a sheet of paper.

Referring to FIG. 1, a conventional printer includes a photoreceptor web 10 which circulates along an endless path while being supported by a plurality of rollers 11, 12 and 13, a main charger 20 disposed adjacent to the photoreceptor web 10 for uniformly charging the surface of the photoreceptor web 10 to a predetermined voltage, a laser scanning unit (LSU) 30 disposed adjacent to the photoreceptor web 10 for forming an electrostatic latent image of a desired image by scanning a laser beam onto the photoreceptor web 10, and a developing unit 40 disposed adjacent to the photoreceptor web 10 for developing the electrostatic latent image by using developer (i.e., ink) which is a mixture of powdered toner having a predetermined color and liquid carrier which is a solvent. For color printing, a plurality of the laser scanning units 30 and the developing units 40 are installed so that the electrostatic latent image can be developed for each of the colors, as shown in the drawing.

The image developed on the photoreceptor web 10 is dried by a drying roller 51 and heating rollers 52 to a state suitable for printing. Then, after being transferred to a transfer roller 61, the image is printed on a sheet of paper P which passes between the transfer roller 61 and a fusing roller 62. Each of the transfer roller 61 and the fusing roller 62 is heated by a predetermined heat source (not shown) so that the image is fixed on the paper P by being heated and pressed.

A paper separating apparatus 70, which guides a leading end of the paper P as it comes out from between the transfer roller 61 and the fusing roller 62 to prevent the paper P from being wound around the transfer roller 61, is installed at an exit side of the transfer roller 61.

However, as shown in FIG. 2A, since the paper P passing between the transfer roller 61 and the fusing roller 62 moves in contact with the upper surface of the paper separating apparatus 70, ink adhering to the paper P is detached from the surface thereof due to friction generated between the image fixed to the bottom surface of the paper P and the paper separating apparatus 70. The detached ink then accumulates on the upper surface of the paper separating apparatus 70. When the ink has accumulated on the upper surface of the paper separating apparatus 70 as described above, the accumulated ink may damage the image of a subsequent sheet of paper. Also, since a frictional force between the paper P and the paper separating apparatus 70 becomes greater, a smooth exit of the paper P is hindered so that a paper jam may occur.

Referring to FIG. 2B, the paper separating apparatus 70 can prevent the paper P from being wound around the transfer roller 61 only when the paper separating apparatus 70 is installed as close to the transfer roller 61 as possible. However, since the paper separating apparatus 70 is installed separated from the transfer roller 61, it is difficult to accurately maintain a gap having a distance D between the paper separating apparatus 70 and the transfer roller 61 due to the mechanical allowance thereof or allowance in installation. Accordingly, when the distance D is too short, the paper separating apparatus 70 may contact and damage the surface of the transfer roller 61 due to vibrations generated during the operation of the printer. On the other hand, the leading end of the paper P may enter and get caught in the gap of the distance D so that the paper P is wound around the transfer roller 61. Also, although the distance D is maintained appropriately, when an adhering force between the image fixed to the paper P and the transfer roller 61 is great, the type of paper jam wherein the paper P gets caught in the gap of distance D may occur because the paper is not separated from the transfer roller 61.

SUMMARY OF THE INVENTION

To solve the above problems, it is an object of the present invention to provide a paper separating apparatus of a printer which is improved to effectively prevent a paper jam wherein the paper is wound around the transfer roller.

Accordingly, to achieve the above object, there is provided a paper separating apparatus of a printer for preventing a paper jam from occurring when a sheet of paper which is passing between a transfer roller and a fusing roller of the printer is wound around the transfer roller, which comprises a separating member installed adjacent to an exit side of the transfer roller and under a path along which the paper is discharged and fixedly coupled to a pair of bearing guides which rotatably support opposite ends of the transfer roller to be operative to pivot by a predetermined angle together with the bearing guides, at least one guide roller installed at an upper surface of the separating member for guiding discharge of the paper, a pivot restricting mechanism which restricts a pivot angle of the separating member and the bearing guides, and an elastic force applying mechanism which applies an elastic force in one direction so that the separating member and the bearing guide can maintain regular positions. In the paper separating apparatus, when a pressure applied by the paper due to an adhesive force between the paper and the transfer roller to the upper surface of the separating member is greater than an elastic force applied by the elastic force applying mechanism, the separating member and the bearing guides pivot by a predetermined angle thereby overcoming the elastic force.

Also, to achieve the above object, there is provided a paper separating apparatus of a printer for preventing a paper jam from occurring when a sheet of paper which is passing between a transfer roller and a fusing roller of the printer is wound around the transfer roller, which comprises a separating member installed adjacent to one side of the transfer roller and under a path along which the paper is discharged and hinge-coupled to a pair of bearing guides which rotatably support opposite ends of the transfer roller to be operative to a pivot by a predetermined angle with respect to the bearing guides, at least one guide roller installed at an upper surface of the separating member for guiding discharge of the paper, a pivot restricting mechanism which restricts a pivot angle of the separating member, and an elastic force applying mechanism which applies an elastic force to the separating member in one direction so that a gap having a predetermined distance is maintained between a circumferential surface of the transfer roller and a surface of the separating member facing the transfer roller.

In the paper separating apparatus, when a pressure applied by the paper due to an adhesive force between the paper and the transfer roller to the upper surface of the separating member is greater than an elastic force applied by the elastic force applying mechanism, the separating member pivots by a predetermined angle thereby overcoming the elastic force and an upper edge portion of the separating member approaches the surface of the transfer roller so that the gap is blocked and the paper is prevented from being caught in the gap.

BRIEF DESCRIPTION OF THE DRAWINGS

The above object and advantages of the present invention will become more apparent by describing in detail preferred embodiments thereof with reference to the attached drawings, in which.

DETAILED DESCRIPTION OF THE PREFERRED EMBODIMENTS

Figure 1:
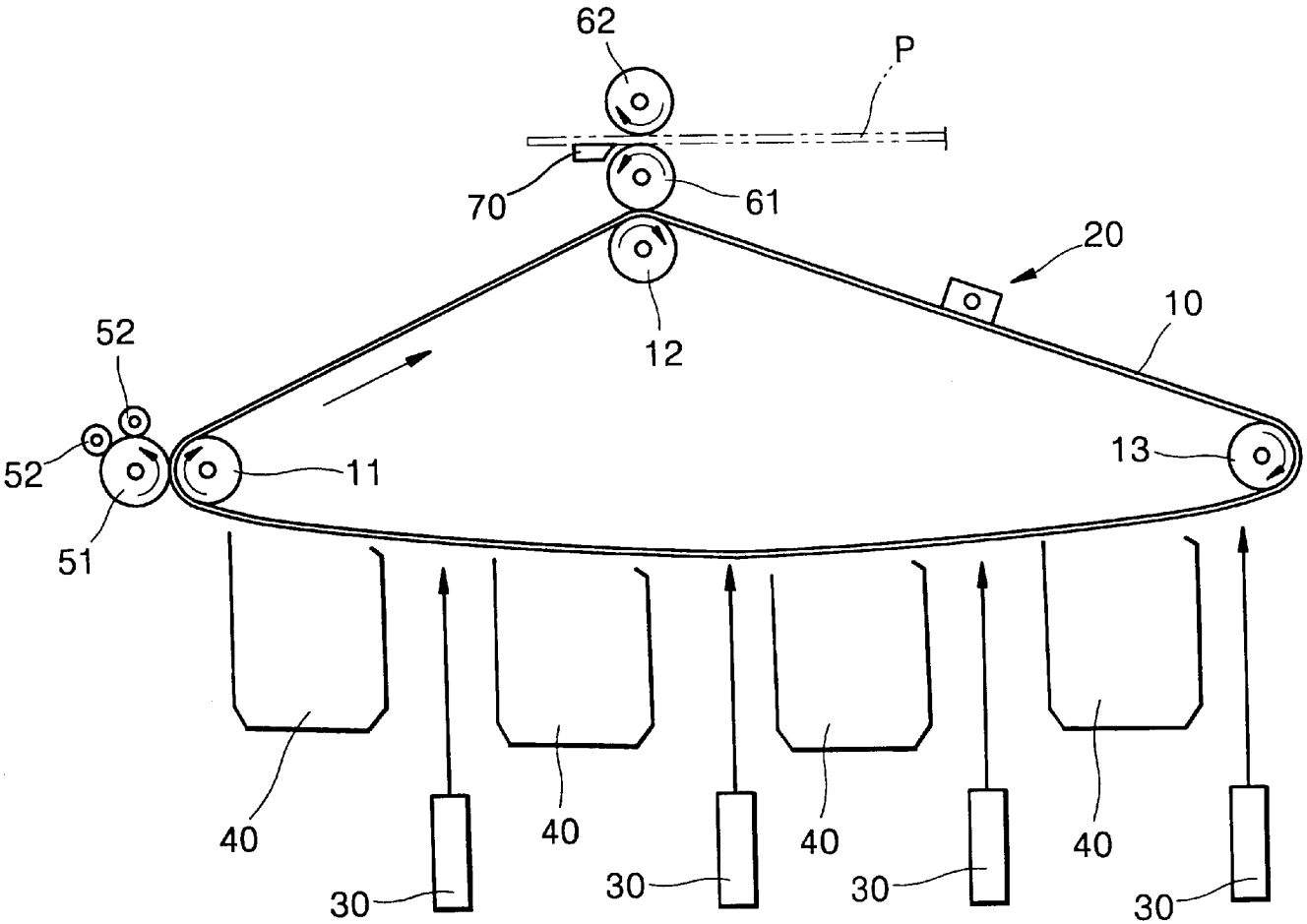
FIG. 1 (PRIOR ART)
FIG.1 is a view showing the structure of the conventional printer.
Figure 2A:
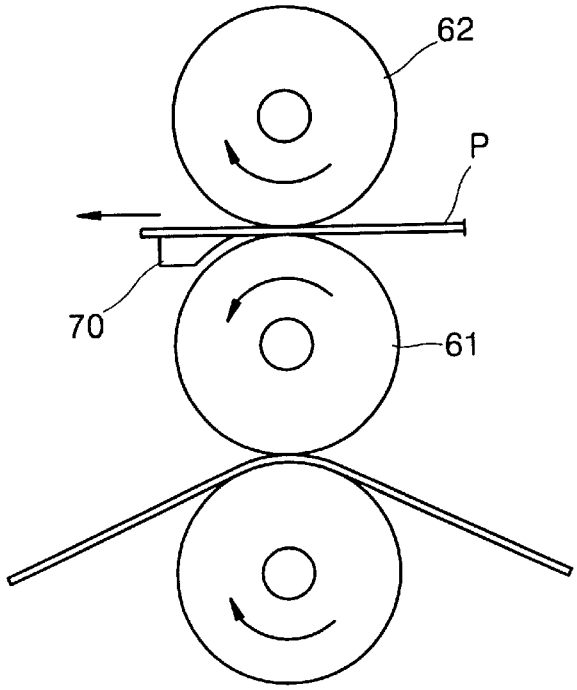
FIG. 2A (PRIOR ART)
FIGS. 2A and 2B are views for explaining an operation in the conventional printer.
Figure 2B:
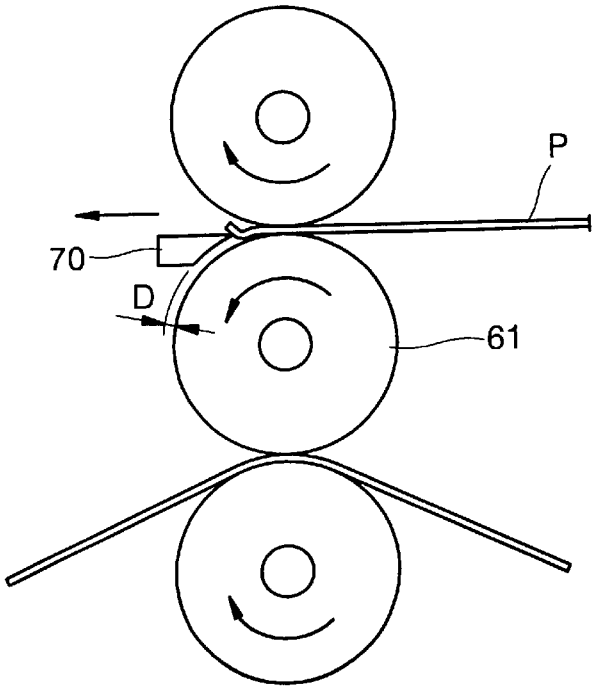
FIG. 2B (PRIOR ART)
Figure 3:
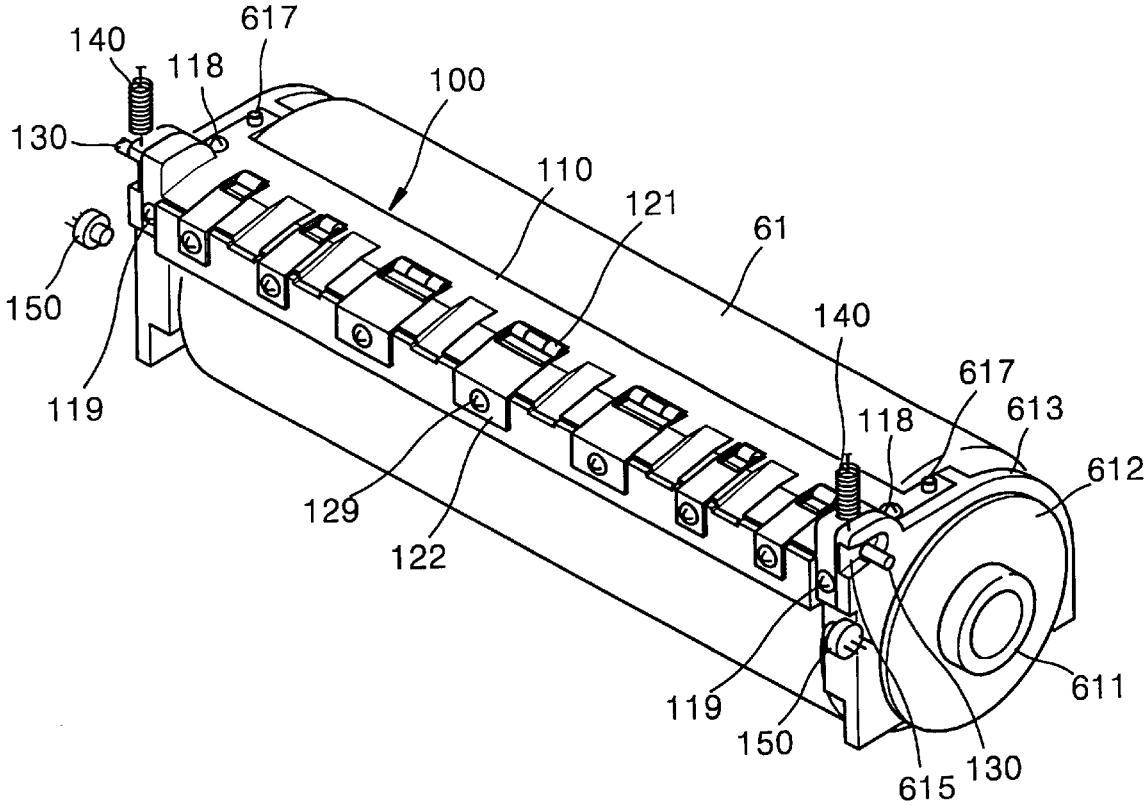
FIG. 3 is a perspective view showing a paper separating apparatus according to a preferred embodiment of the present invention.
Figure 4:
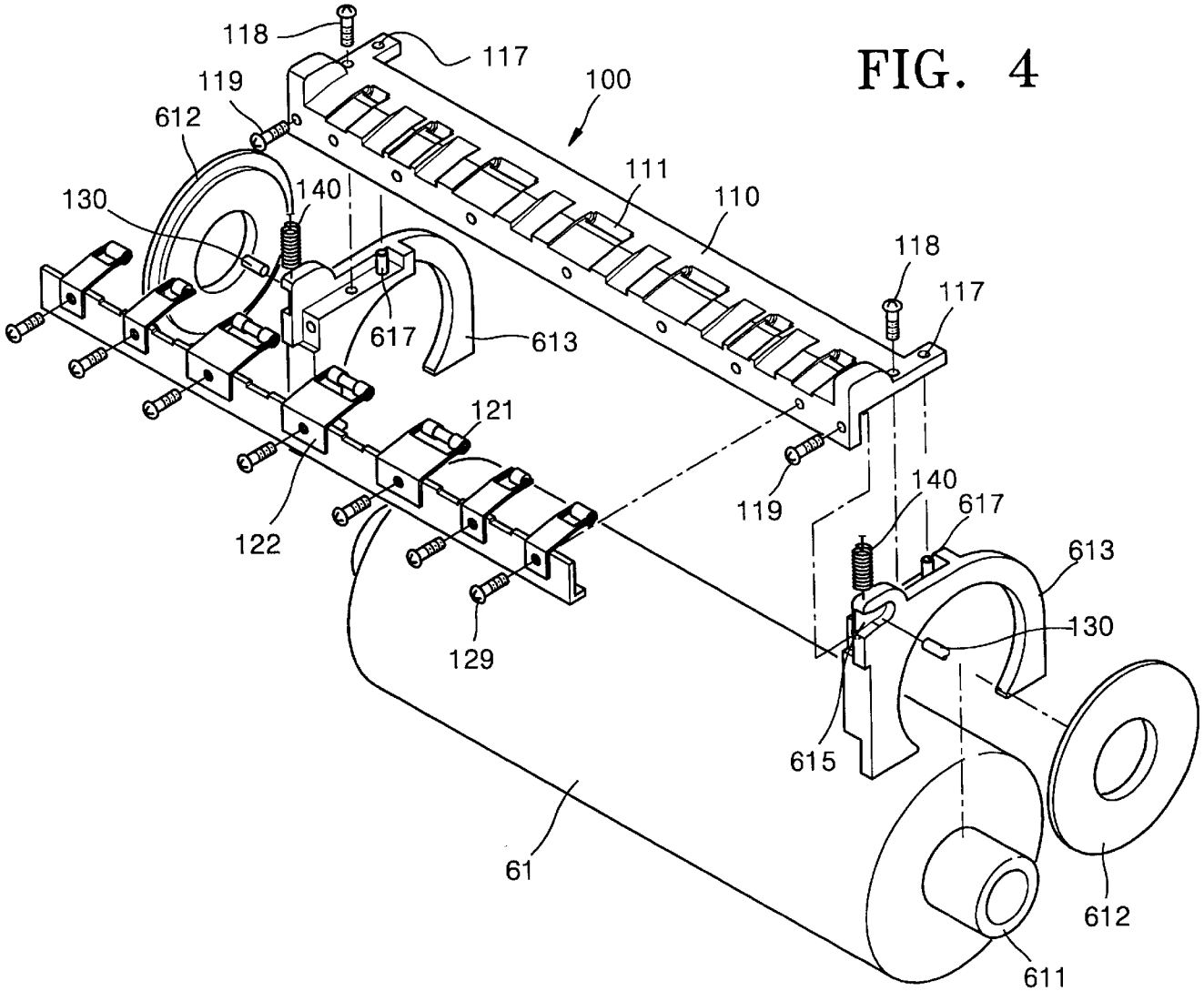
FIG. 4 is an exploded perspective view of the paper separating apparatus shown in FIG. 3.

Referring to FIGS. 3 and 4, a paper separating apparatus 100 of a printer according to a preferred embodiment of the present invention includes a separating member 110 for separating a sheet of paper from the surface of the transfer roller 61, at least one guide roller 121 for guiding the exit of the paper, a pivot restricting mechanism for restricting the pivot angle of the separating member 110, and an elastic force applying mechanism for applying an elastic force to the separating member 110 in one direction.

The separating member 110 is installed close to the exit side of the transfer roller 61, that is, at the side that the paper is discharged, and a paper exit path is disposed just above the separating member 110. The transfer roller 61 is rotatably supported by a pair of bearing guides 613, and a bearing 612 is interposed between either end portion of a roller shaft 611 and the corresponding bearing guide 613. The two end portions of the separating member 110 are fixed to the respective bearing guides 613 by coupling bolts 118 and 119. In this case, to secure accurate relative positions between the separating member 110 and the bearing guides 613, a position fixing pin 617 is provided at the upper surface of each bearing guide 613 and a pin insertion hole 117 into which the position fixing pin 617 is inserted is provided at either end portion of the separating member 110. The bearing guides 613 are installed to be capable of pivoting by a predetermined angle around the roller shaft 611 of the transfer roller 61. Accordingly, the separating member 110 can pivot together with the bearing guides 613.

Since both the separating member 110 and the transfer roller 61 are coupled to the bearing guides 613, allowance in assembly of the separating member 110 is minimized so that the distance between the separating member 110 and the transfer roller 61 is always maintained uniformly. Thus, the distance between the separating member 110 and the transfer roller 61 can be minimized and thus the paper can be prevented from being caught in the gap between the separating member 110 and the transfer roller 61.

The guide roller 121 is installed at the upper surface of the separating member 110 to guide the paper being discharged. A roller insertion groove 111 for accommodating the lower portion of the guide roller 121 is formed at the upper surface of the separating member 110. Accordingly, the guide roller 121 protrudes from the upper surface of the separating member 110 as high as the radius thereof. Also, to minimize an opportunity that the paper passing the transfer roller 61 contacts the upper surface of the separating member 110, the guide roller 121 is installed to be as close to the transfer roller 61 as possible.

The guide roller 121 can be formed as a body having a length enough to cover the full width of the paper. However, it is preferable that a plurality of guide rollers are formed in a lengthwise direction of the separating member 110 at predetermined intervals. Since each of the guide rollers 121 is supported by a leaf spring 122, the pressure applied to the guide roller 121 by the paper can be compensated for. That is, both ends of each guide roller 121 are rotatably coupled to a corresponding leaf spring 122 and the leaf spring 122 is coupled to the separating member 110 by a coupling bolt 129 (See FIG. 4).

A tension spring 140 is adopted as the elastic force applying mechanism, with there being a tension spring 140 associated with each bearing guide 613. One end of each tension spring 140 is fixed to a frame (not shown) of the printer and the other end thereof is coupled to the upper portion of a corresponding one of the bearing guides 613. The tension spring 140 applies an elastic force in one direction so that the separating member 110 and the corresponding bearing guide 613 maintain regular positions. Thus, when the paper is normally discharged, the separating member 110 and the bearing guides 613 do not pivot while maintaining the regular positions due to the tension springs 140.

However, when pressure applied by the paper to the upper surface of the separating member 110 due to an adhesive force between the paper and the transfer roller 61 is greater than an elastic force applied by the tension spring 140, the separating member 110 and the bearing guide 613 pivot by a predetermined angle overcoming the elastic force. In this case, the pivot restricting mechanism restricts the pivot angle of the separating member 110 and the bearing guides 613.

The pivot restricting mechanism comprises, a pin insertion groove 615 having a predetermined width in a vertical direction which is provided at each of the bearing guides 613 and a corresponding pivot restricting pin 130 having one end inserted into the pin insertion groove 615 and the other end fixed to the frame of the printer. Thus, when the separating member 110 and the bearing guides 613 pivot by a predetermined angle, the upper and lower surfaces of the pin insertion grooves 615 contact the pivot restricting pins 130 so that further pivoting is prevented.

The paper separating apparatus 100 in a printer according to a preferred embodiment of the present invention may further include a sensor 150 for detecting whether the separating member 110 pivots. An optical sensor or a proximity sensor can be adopted as the sensor 150. When the pivoting of the separating member 110 is detected by the sensor 150, the operation of the printer is stopped so that the paper is prevented in advance from being caught in the gap between the separating member 110 and the transfer roller 61.

The operation of the paper separating apparatus having the above structure according a preferred embodiment of the present invention will be described with reference to FIGS. 5A and 5B.

Figure 5A:
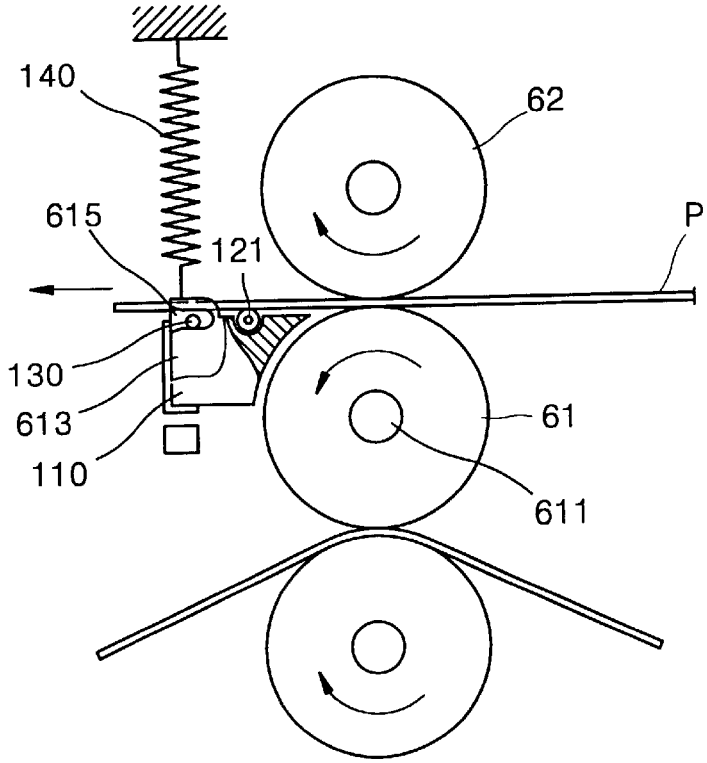
FIGS. 5A and 5B are views for explaining the operation of the paper separating apparatus shown in FIG. 3.

Referring to FIG. 5A, the separating member 110 is installed such that the upper surface thereof is set to about 1 mm below a path along which the paper P passes. The at least one guide roller 121 is installed to protrude about 0.8 mm–1 mm above the upper surface of the separating member 110. When the paper P passing between the transfer roller 61 and the fusing roller 62 is normally separated from the transfer roller 61, the paper P is smoothly discharged by being guided by the guide roller 121 installed at the upper surface of the separating member 110. Thus, since the normally discharged paper P contacts the guide roller 121 without creating friction with the upper surface of the separating member 110, the paper can be smoothly discharged so that damage to an image fixed to the paper can be prevented.

In this case, the separating member 110 and the bearing guide 613 maintain the regular positions by the tension spring 140 and the pivot restricting pin 130. That is, since the pivot restricting pin 130 is in close contact with the lower surface of the pin insertion groove 615, the separating member 110 and the bearing guide 613 are prevented from further pivoting clockwise around the roller shaft 611 from the regular positions.

Figure 5B:
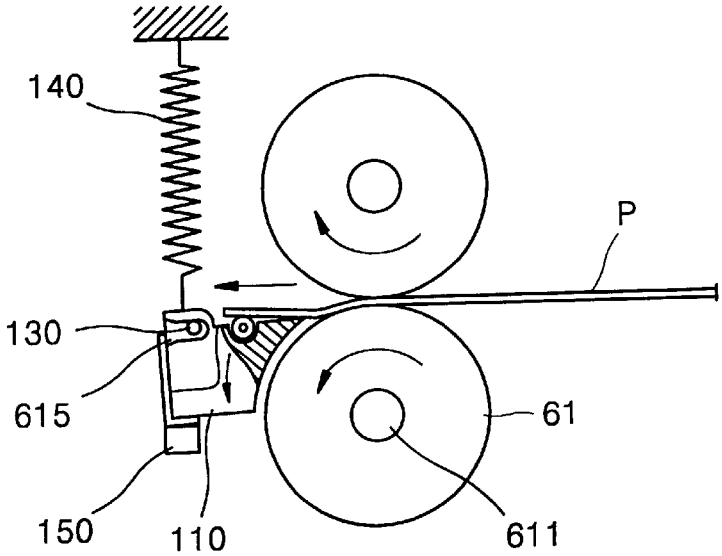

However, as shown in FIG. 5B, when an adhesive force between the paper P and the transfer roller 61 is great, the paper P is not easily separated from the surface of the transfer roller 61 and rotates together with the transfer roller 61 as being adhered to the surface of the transfer roller 61. Accordingly, the leading end portion of the paper P presses the upper surface of the separating member 110. Here, when the pressure applied by the paper P to the upper surface of the separating member 110 is greater than the elastic force applied by the tension spring 140, the separating member 110 and the bearing guide 613 pivot counterclockwise around the roller shaft 611 while overcoming the elastic force. When the separating member 110 and the bearing guide 613 pivot by a predetermined angle, the upper surface of the pin insertion groove 615 contacts the pivot restricting pin 130 so that further pivoting is restricted.

Likewise, when the adhesive force between the paper P and the transfer roller 61 is great so that the paper P is not easily separated from the transfer roller 61, the separating member 110 pivots a predetermined angle and delays entering of the paper P between the separating member 110 and the transfer roller 61. While the separating member 110 pivots, a restoring force to a flat state gradually increases so that the paper P is separated from the surface of the transfer roller 61. When the paper P is separated from the surface of the transfer roller 61 while the separating member 110 pivots, the pressure applied to the separating member 110 decreases so that the separating member 110 returns to its original position due to the elastic force by the tension spring 140 and the paper P is normally discharged.

However, in the case in which the paper P is not separated while the separating member 110 pivots, the separating member 110 continues to pivot until it is restricted by the pivot restricting pin 130. Here, the sensor 150 detects the pivoting of the separating member 110. Accordingly, by stopping the operation of the printer, the type of paper jam wherein the paper P is caught in a gap between the separating member 110 and the transfer roller 61 can be prevented in advance.

Figure 6:
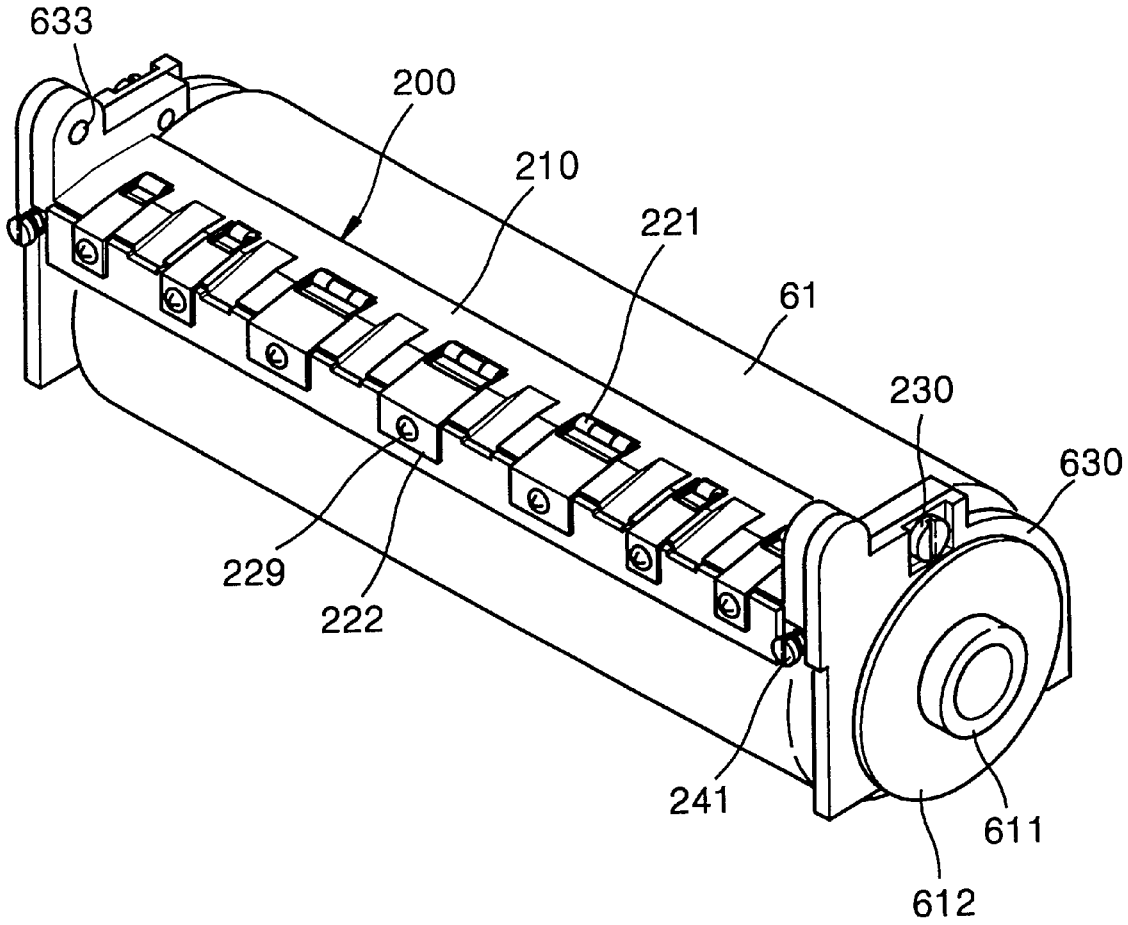
FIG. 6 is a perspective view showing a paper separating apparatus according to another preferred embodiment of the present invention.
Figure 7:
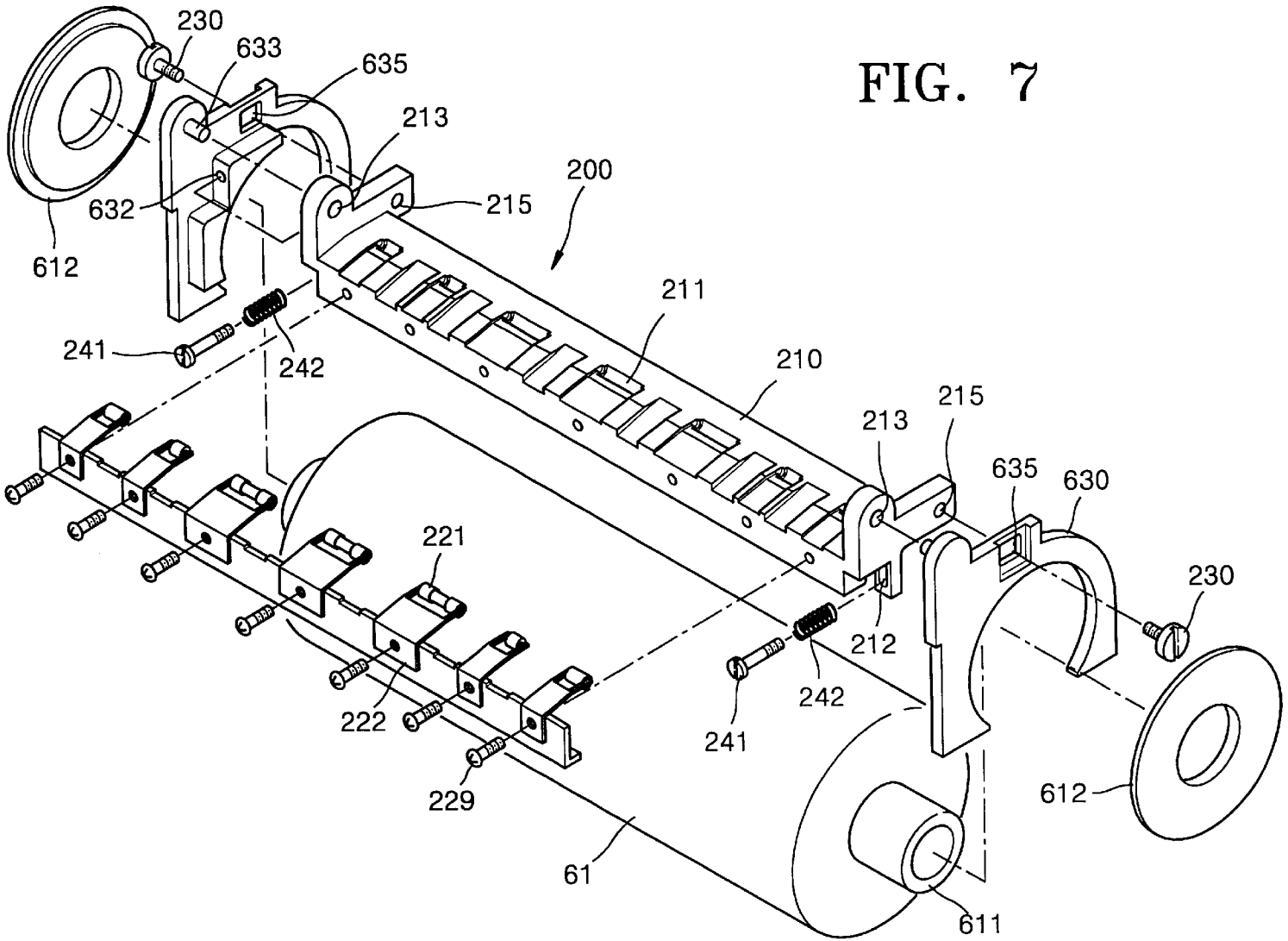
FIG. 7 is an exploded perspective view of the paper separating apparatus shown in FIG. 6.

Referring to FIGS. 6 and 7, a paper separating apparatus 200 according to another preferred embodiment of the present invention includes a separating member 210 for separating a sheet of paper (not shown) from the surface of the transfer roller 61, at least one guide roller 221 for guiding the discharge of the paper, a pivot restricting mechanism for restricting the pivot angle of the separating member 210, and an elastic force applying mechanism for applying an elastic force in one direction to the separating member 210.

The separating member 210 is installed to be adjacent to the discharge side of the transfer roller 61, that is, the side that the paper is discharged, and a discharge pass along which the paper is discharged is located above the separating member 210. The transfer roller 61 is rotatably supported by a pair of bearing guides 630, and a bearing 612 is interposed between each of the end sides of the transfer roller 61 and the corresponding bearing guide 630; that is, the roller shaft 611 and the corresponding bearing guide 630. The bearing guide 630 is fixedly provided. The end portions of the separating member 210 are hinge-coupled to the respective bearing guides 630 to be capable of pivoting by a predetermined angle with respect to the bearing guides 630. For the hinge coupling between the separating member 210 and the bearing guides 630, a hinge pin 633 is formed to protrude at the inner side of each of the bearing guides 630 and corresponding hinge holes 213 into which the respective hinge pins 633 are inserted, are provided at the opposite end portions of the separating member 210.

In the paper separating apparatus according to the further preferred embodiment of the present invention, since both the separating member 210 and the transfer roller 61 are coupled to or supported by the bearing guides 630, the same effect as in the previous embodiment can be obtained.

The guide roller 221 is installed at the upper surface of the separating member 210 to guide the paper being discharged. A roller insertion groove 211 for accommodating the lower portion of the guide roller 221 is formed at the upper surface of the separating member 210. In this case, a plurality of the guide rollers 221 can be installed at predetermined intervals in a lengthwise direction of the separating member 210. Also, each of the guide rollers 221 is supported by a leaf spring 222 so that pressure applied by the paper is compensated for. Each leaf spring 222 is coupled to the separating member 210 by using a coupling bolt 229.

The elastic force applying mechanism includes an adjustment screw 241 and a compression spring 242 and applies an elastic force to the separating member 210 in one direction so that a gap of a predetermined distance can be maintained between the outer circumferential surface of the transfer roller 61 and the surface of the separating member 210 facing the transfer roller 61. In this case, an adjustment screw 241 and compression spring 242 are associated with each bearing guide 630. The adjustment screws 241 are coupled to corresponding adjustment coupling holes 632 provided in the respective bearing guides 630 by passing through corresponding adjustment screw insertion holes 212 provided at either end portion of the separating member 210. Each compression spring 242 is installed around the corresponding adjustment screw 241 to be interposed between the head of the adjustment screw 241 and the separating member 210 and applies an elastic force in one direction so that the separating member 210 can maintain the regular position. Thus, when the paper is normally discharged, the separating member 210 maintains the regular position without pivoting. When the adjustment screws 241 are adjusted, the elastic force applied to the separating member 210 can be adjusted.

However, when the pressure applied the upper surface of the separating member 210 due to an adhesive force between the paper and the transfer roller 61 is greater than the elastic force applied by the compression spring 242, the separating member 210 pivots by a predetermined angle around the hinge pins 633 overcoming the elastic force. Accordingly, as the upper end edge portion of the separating member 210 approaches the surface of the transfer roller 61, the gap between the separating member 210 and the transfer roll 61 is blocked so that the paper cannot be inserted therebetween.

The pivot restricting mechanism for restricting a pivot angle of the separating member 210 includes a pivot restricting hole 635 provided at each of the bearing guides 630 and having a predetermined width in a vertical direction, a screw coupling hole 215 provided at either end portion of the separating member 210, and a pivot restricting screw 230 coupled to the screw coupling hole 215 via the pivot restricting hole 635. Each pivot restricting screw 230 pivots together with the separating member 210 but its movement is limited in the corresponding pivot restricting hole 215. Thus, when the separating member 210 pivots by a predetermined angle, the pivot restricting screws 230 contact the inner surface of the respective pivot restricting holes 635 to prevent further pivoting.

The operation of the paper separating apparatus having the above structure according to the further preferred embodiment of the present invention will be described with reference to FIGS. 8A and 8B.

Figure 8A:
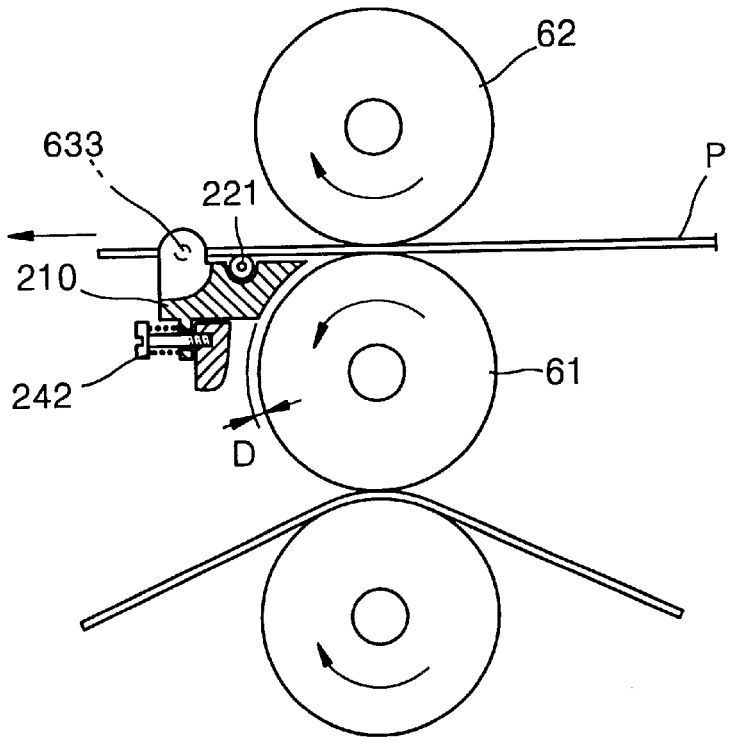
FIGS. 8A and 8B are views for explaining the operation of the paper separating apparatus shown in FIG. 6.

Referring to FIG. 8A, when the paper P passing between the transfer roller 61 and the fusing roller 62 is normally separated from the transfer roller 61, the paper P can be smoothly discharged by being guided by the guide roller 221 installed at the upper surface of the separating member 210. Since the paper P does not create friction with the upper surface of the separating member 210, damage to an image formed on the paper P due to the friction can be prevented.

Here, the separating member 210 maintains the regular position by the compression springs 242 and the pivot restricting screws 230 (see FIG. 6). That is, the elastic force by the compression springs 242 is applied to the separating member 210 so as to pivot counterclockwise around the hinge pins 633. However, the separating member 210 is prevented by the pivot restricting screws 230 from pivoting further from the regular position. Thus, a gap having a predetermined distance D can be maintained between the separating member 210 and the transfer roller 61.

Figure 8B:
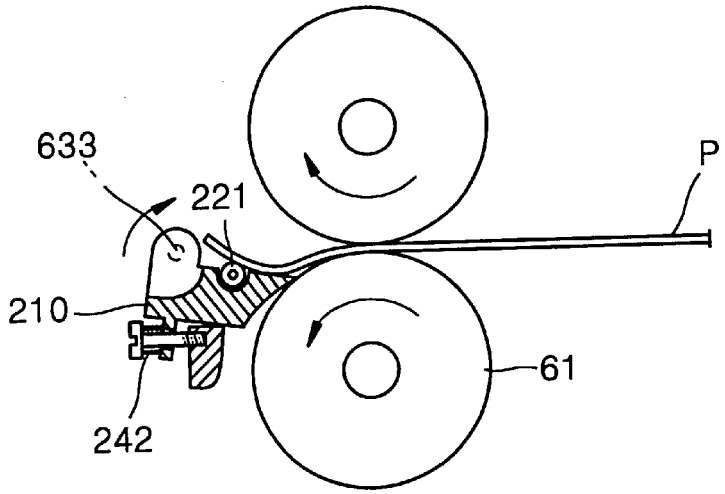

However, as shown in FIG. 8B, when the adhesive force between the paper P and the transfer roller 61 is great, the paper P is not easily separated from the surface of the transfer roller 61 and moves in contact with the surface of the transfer roller 61. Accordingly, the lead end portion of the paper P presses the upper surface of the separating member 210. Here, when the pressure applied by the paper P to the upper surface of the separating member 210 is greater than the elastic force applied by the compression springs 242, the separating member 210 pivots clockwise around the hinge pins 633 thereby overcoming the elastic force. When the separating member 210 pivots by a predetermined angle, further pivoting is prevented by the pivot restricting screws 230. When the separating member 210 pivots as above, the edge portion of the separating member 210 approaches or contacts the surface of the transfer roller 61 and the gap between the separating member 210 and the transfer roller 61 is blocked. Therefore, the paper P is prevented from being caught in the gap.

As described in the above, the paper separating apparatus of a printer according to the present invention has the following advantages.

First, since the separating member is installed at the bearing guides of the transfer roller, the gap between the transfer roller and the separating member can be accurately maintained and minimized so that the paper is prevented from being caught in the gap.

Second, when the adhesive force between the paper and the transfer roller is great, the separating member pivots and thus the rotating roller is stopped, or since the gap between the separating member and the transfer roller is blocked, the generation of a paper jam wherein the paper is caught in the gap can be prevented.

Third, since the paper can be smoothly exhausted by the guide roller installed at the upper surface of the separating member, the damage to the image formed on the paper can be prevented.

It is contemplated that numerous modifications may be made to the paper separating apparatus of the present invention without departing from the spirit and scope of the invention as defined in the following claims.

What is claimed is:

1. A paper separating apparatus of a printer for preventing a paper jam from occurring when a sheet of paper which is passing between a transfer roller and a fusing roller of the printer is wound around the transfer roller, the paper separating apparatus comprising:

a separating member installed adjacent to an exit side of the transfer roller and under a path along which the paper is discharged and fixedly coupled to a pair of bearing guides which rotatably support opposite ends of the transfer roller to be operative to pivot by a predetermined angle together with the bearing guides;

at least one guide roller installed at an upper surface of the separating member for guiding discharge of the paper;

a pivot restricting mechanism which restricts a pivot angle of the separating member and the bearing guides; and an elastic force applying mechanism which applies an elastic force in one direction so that the separating member and the bearing guides can maintain regular positions, wherein, when a pressure applied by the paper due to an adhesive force between the paper and the transfer roller to the upper surface of the separating member is greater than an elastic force applied by the elastic force applying mechanism, the separating member and the bearing guides pivot by a predetermined angle thereby overcoming the elastic force.

2. The apparatus as claimed in claim 1, further comprising a sensor for detecting whether the separating member pivots.

3. The apparatus as claimed in claim 1, wherein the pivot restricting mechanism comprises:

a pin insertion groove provided at an outer surface of at least one of the bearing guides; and a pivot restricting pin having one end portion inserted in the pin insertion groove and the other end portion fixedly installed at a frame of the printer, wherein, when the separating member and the bearing guides pivot, an inner surface of the pin insertion groove contacts the pivot restricting pin so that the pivot angle of the separating member is restricted.

4. The apparatus as claimed in claim 1, wherein the elastic force applying mechanism comprises at least one tensile spring having one end portion fixed to a frame of the printer and another end portion connected to an upper end portion of at least one of the bearing guides.

5. The apparatus as claimed in claim 1, wherein said at least one guide roller comprises a plurality of guide rollers installed at predetermined intervals in a lengthwise direction of the separating member.

6. The apparatus as claimed in claim 1, wherein a leaf spring is interposed between the at least one guide roller and the separating member so that the pressure applied by the paper is reduced.

7. The apparatus as claimed in claim 1, wherein a roller insertion groove is formed at the upper surface of the separating member to accommodate a lower portion of the at least one guide roller.

8. A paper separating apparatus of a printer for preventing a paper jam from occurring when a sheet of paper which is passing between a transfer roller and a fusing roller of the printer is wound around the transfer roller, the paper separating apparatus comprising:

a separating member installed adjacent to one side of the transfer roller and under a path along which the paper is discharged and hinge-coupled to a pair of bearing guides which rotatably support opposite ends of the transfer roller to be operative to pivot by a predetermined angle with respect to the bearing guides;

at least one guide roller installed at an upper surface of the separating member for guiding discharge of the paper;

a pivot restricting mechanism which restricts a pivot angle of the separating member; and an elastic force applying mechanism which applies an elastic force to the separating member in one direction so that a gap having a predetermined distance is maintained between a circumferential surface of the transfer roller and a surface of the separating member facing the transfer roller, wherein, when a pressure applied by the paper due to an adhesive force between the paper and the transfer roller to the upper surface of the separating member is greater than an elastic force applied by the elastic force applying mechanism, the separating member pivots by a predetermined angle thereby overcoming the elastic force and an upper edge portion of the separating member approaches the surface of the transfer roller so that the gap is blocked and the paper is prevented from being caught in the gap.

9. The apparatus as claimed in claim 8, wherein the separating member is hinge-coupled to at least one of the bearing guides by a hinge pin installed to protrude from a surface of the at least one bearing guide and a hinge hole provided at an end portion of the separating member so that the hinge pin is inserted therein.

10. The apparatus as claimed in claim 8, wherein the pivot restricting mechanism comprises:

a pivot restricting hole provided at at least one of the bearing guides;

a screw coupling hole provided at an end portion of the separating member; and a pivot restricting screw coupled to the screw coupling hole through the pivot restricting hole, wherein the pivot restricting screw pivoting together with the separating member restrictedly pivots within the pivot restricting hole.

11. The apparatus as claimed in claim 8, wherein the elastic force applying mechanism comprises:

an adjustment screw insertion hole provided at an end portion of the separating member;

an adjustment screw coupling hole provided at at least one of the bearing guides;

an adjustment screw coupled to the adjustment coupling hole through the adjustment screw insertion hole; and a compression spring installed around the adjustment screw so as to be interposed between a head of the adjustment screw and the separating member, wherein the compression spring applies an elastic force to the separating member in one direction so that the elastic force is adjusted by adjusting the adjustment screw.

* * * * *